US005983535A

United States Patent [19]

Kaczmarski et al.

[11] Patent Number: 5,983,535

[45] **Date of Patent: *Nov. 16, 1999**

[54] FASTENER SECURED FRAME FOR BOOM MOUNTED QUICK CHANGE BRACKET

[75] Inventors: Wally L. Kaczmarski, Lisbon; Craig A. Berard, Oakes, both of N. Dak.

[73] Assignee: Clark Equipment Company, Woodcliff Lake, N.J.

[ * ] Notice: This patent is subject to a terminal disclaimer.

[21] Appl. No.: 09/034,539

[22] Filed: Mar. 3, 1998

Related U.S. Application Data

[63] Continuation-in-part of application No. 08/814,313, Mar. 10, 1997.

[51] Int. Cl.[6] ..... E02F 3/36

[52] U.S. Cl. ..... 37/468; 37/903

[58] Field of Search ..... 172/272, 275; 37/468, 903

[56] References Cited

U.S. PATENT DOCUMENTS

| | | | |
|---|---|---|---|
| 2,963,183 | 12/1960 | Przybylski . | |
| 3,237,795 | 3/1966 | Kromer . | |
| 4,213,731 | 7/1980 | Verachtert | 414/723 |
| 4,214,840 | 7/1980 | Beales | 430/31 |
| 4,225,283 | 9/1980 | Baker et al. | 414/723 |
| 4,477,101 | 10/1984 | Nilsson et al. | 172/272 X |
| 4,480,955 | 11/1984 | Andrews et al. | 414/723 |
| 4,632,595 | 12/1986 | Schaeff | 430/330 |
| 4,929,143 | 5/1990 | Dohnalik | 414/723 |
| 5,024,010 | 6/1991 | Hulden | 37/468 |
| 5,082,389 | 1/1992 | Balemi | 403/322 |
| 5,098,252 | 3/1992 | Sheesley et al. | 414/723 |
| 5,107,610 | 4/1992 | Fusco | 37/103 |
| 5,110,254 | 5/1992 | Aubrey | 414/723 |
| 5,145,313 | 9/1992 | Weyer | 414/723 |
| 5,147,173 | 9/1992 | Fauber et al. | 414/723 |
| 5,332,353 | 7/1994 | Arnold | 414/723 |
| 5,333,695 | 8/1994 | Walter | 172/272 |
| 5,350,250 | 9/1994 | Nagler | 403/316 |
| 5,415,235 | 5/1995 | Gebauer | 37/468 |
| 5,431,528 | 7/1995 | Jenkins et al. | 37/468 |
| 5,597,283 | 1/1997 | Jones | 37/468 |
| 5,692,325 | 12/1997 | Kuzutani | 37/468 |
| 5,727,342 | 3/1998 | Horton | 37/468 |

FOREIGN PATENT DOCUMENTS

| | | | |
|---|---|---|---|
| 1071151 | 2/1980 | Canada | 37/468 |
| 0 321 902 A1 | 6/1989 | European Pat. Off. . | |
| 0 472 115 | 2/1992 | European Pat. Off. . | |
| 0 521 560 B1 | 1/1993 | European Pat. Off. . | |
| 0 637 649 A2 | 2/1995 | European Pat. Off. . | |
| 0 672 796 A1 | 9/1995 | European Pat. Off. . | |
| 2 690 718 | 11/1993 | France . | |
| 90 00 721 | 4/1990 | Germany . | |
| 7904335 | 12/1980 | Netherlands | 37/468 |
| 763531 | 9/1980 | U.S.S.R. | 37/468 |
| 2 040 262 | 8/1980 | United Kingdom . | |
| 2 068 332 | 8/1981 | United Kingdom . | |
| 2169582 | 7/1986 | United Kingdom | 37/468 |
| 8802421 | 4/1988 | WIPO | 37/468 |

*Primary Examiner*—Christopher J. Novosad
*Attorney, Agent, or Firm*—Westman, Champlin & Kelly, P.A.

[57] ABSTRACT

A quick attach accessory tool mounting frame is adapted to be mounted onto a quick attachment bracket and held in place. The adapter frame has spaced side plates that slide over a bracket and with a linear movement can be held in place on the bracket. The frame is held in place on the bracket with bolts that draw the bracket and frame together.

18 Claims, 5 Drawing Sheets

FASTENER SECURED FRAME FOR BOOM MOUNTED QUICK CHANGE BRACKET

CROSS REFERENCE TO RELATED APPLICATION

This application is a continuation-in-part of copending application Ser. No. 08/814,313, filed Mar. 10, 1997, for ATTACHMENT CONSTRUCTION FOR EARTHWORKING IMPLEMENT.

Reference is also made to application Ser. No. 09/028,074, filed Feb. 23, 1998, entitled FRAME FOR MOUNTING ON A BOOM MOUNTED QUICK CHANGE BRACKET.

BACKGROUND OF THE INVENTION

The present invention relates to a mounting frame for attachment to a tool such as a clamshell, bucket, grapple, or power unit support for an auger, hydraulic hammer, or compactor, that will permit quick attachment to a bracket on an arm or boom, such as a backhoe or excavator arm, and which uses threaded fasteners for latching the frame in place.

With the advance of reliable, positive locking quick attachment brackets, it has become desirable to use a quick attachment arrangement for interchanging buckets, power earth augers, compactors, clam shells, grapples, breakers and other implements as well.

Efforts have been made to provide couplings that can automatically connect tools to an articulated arm of an excavator, backhoe or the like and while many include automatic latches for holding the parts assembled, a simple, low cost manual securement, after mounting the frame on the bracket, can be used.

A readily usable frame that will easily adapt for use on a wide variety of attachments is desired.

SUMMARY OF THE INVENTION

The present invention relates to a mounting frame having an adapter plate that can be attached to a wide range of tools and accessories for a backhoe or excavator, or other implements that support a mating quick change bracket. The mounting frame permits coupling to an attachment bracket on a boom or arm and is adaptable to be used with several types of tools. The frame can be welded to the tool, or in cases where the tool normally is attached to an arm with pin connectors, the frame can include an adapter plate that pins to the existing pin holes on the tool. The frame can be otherwise supported on the tool as well.

In a preferred form of the present invention a quick attachment bracket is mounted on a backhoe or excavator arm and the mounting frame couples to the quick attachment bracket by moving the boom. The quick attachment bracket is pivoted on the arm about a horizontal axis and is connected to the operating linkage so it can be pivoted under power.

The quick attachment bracket and the mounting frame of the present invention are made to slide together with a linear motion provided with the boom or arm. As the bracket slides into place on the mounting frame under power operation, the mounting frame seats in a receptacle on the bracket at one end and receives and retains a nose piece of the quick attachment bracket in a retainer slot formed by walls at the other end of the frame. The frame and bracket are secured together in the present invention with pins, as shown threaded fasteners that permit drawing the frame and the bracket together for final seating and locking. As shown, a support bar on the frame aligning with apertures in the nose piece on the bracket and bolts are passed through the apertures and tightened to hold the parts together. The tightening pulls the frame and bracket together to seat the mating attachment parts positively.

The frame is usable on a wide variety of tools that now are pinned to linkages on the arm of a backhoe or excavator. The frame can be universal, and can include a section for an automatic latch, if the bracket is so equipped. The omission of the automatic latch components on the bracket reduces costs substantially.

DETAILED DESCRIPTION OF THE PREFERRED EMBODIMENTS

Figure 1:
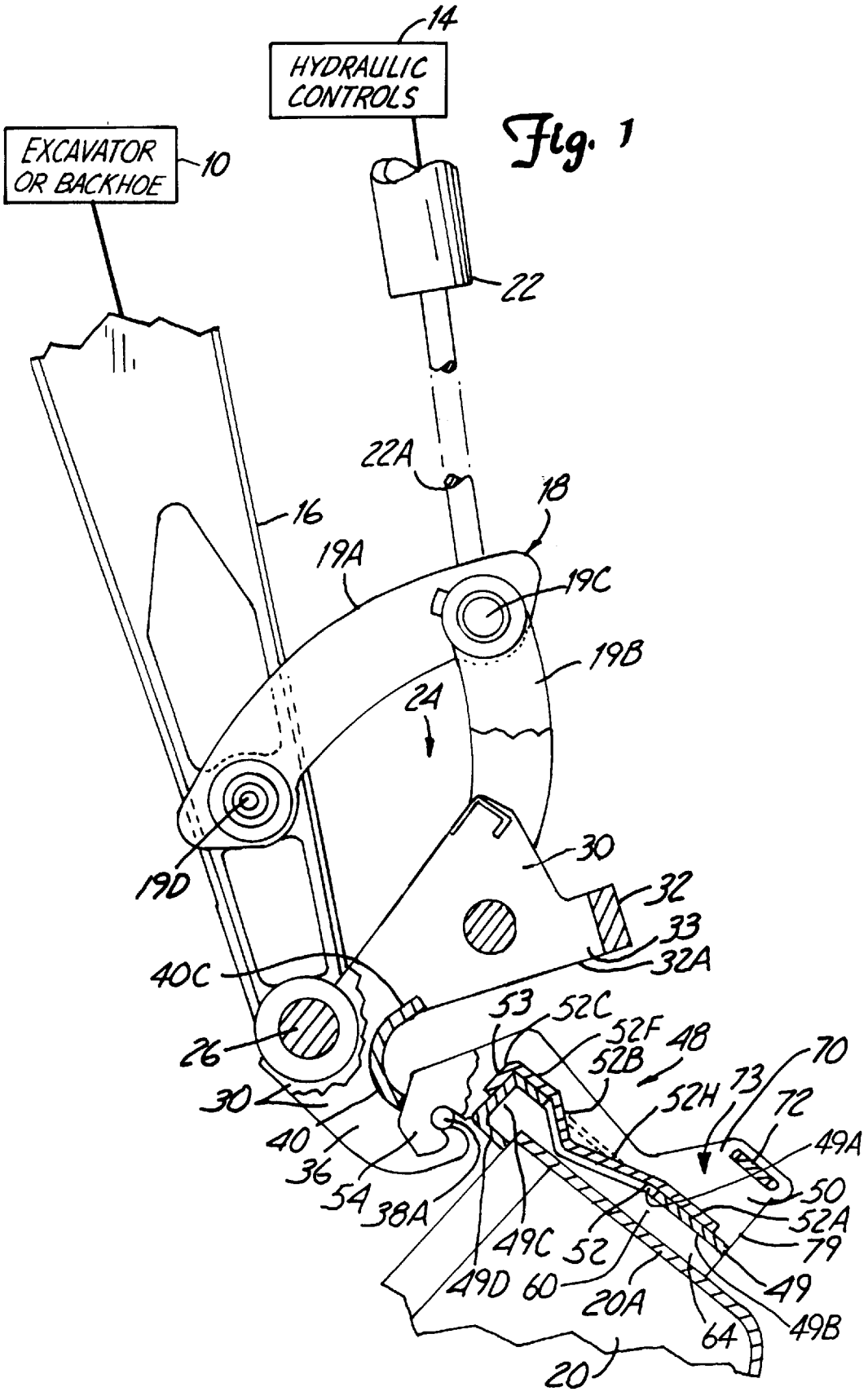
FIG. 1 is a schematic representation of a backhoe or excavator arm having a quick attachment bracket for receiving and holding a mounting frame made according to the present invention installed on a conventional bucket with parts in section and parts broken away.

A powered implement arm 16 such as on an excavator or backhoe is used to mount an auxiliary tool, as shown a bucket 20. The arm 16 is pivotally mounted to a boom arm section that is in turn pivotally mounted to the excavator or backhoe represented at 10. The arm 16 is controlled and operated from the mounting platform, using hydraulic actuators operated from a source of hydraulic fluid under pressure, and operated by valve controls 14. An outer end of the arm 16 as shown mounts a link assembly 18 that is used for controlling pivoting of a tool represented as a bucket 20 relative to the arm 16. The link assembly 18 is actuated with a double acting hydraulic actuator shown at 22 and operated through valve 14. The actuator 22 extends and retracts an actuator rod 22A under power and controls pivotal movement of a quick attachment mounting bracket 24 that is pivotally mounted on a pin 26 to the outer end of the arm 16. The actuator 22, acting through link assembly 18 will control pivoting of the bracket 24 about the horizontal axis of the pin 26. The hydraulic actuator 22 can be attached directly to the bracket 24 to eliminate the link assembly 18, if desired.

The link assembly 18 as shown, has a pair of links 19A and 19B that are pivotally mounted together with a pin 19C. The pin 19C also is the attachment pin for the actuator rod 22A. The links 19A and 19B are suitably bifurcated to permit attachment on the single pin 19C. The link 19A is pivotally mounted to the arm 16 with the pin 19D and the outer end of link 19B is pivotally mounted to quick attachment bracket 24 with a pin 28.

Figure 2:
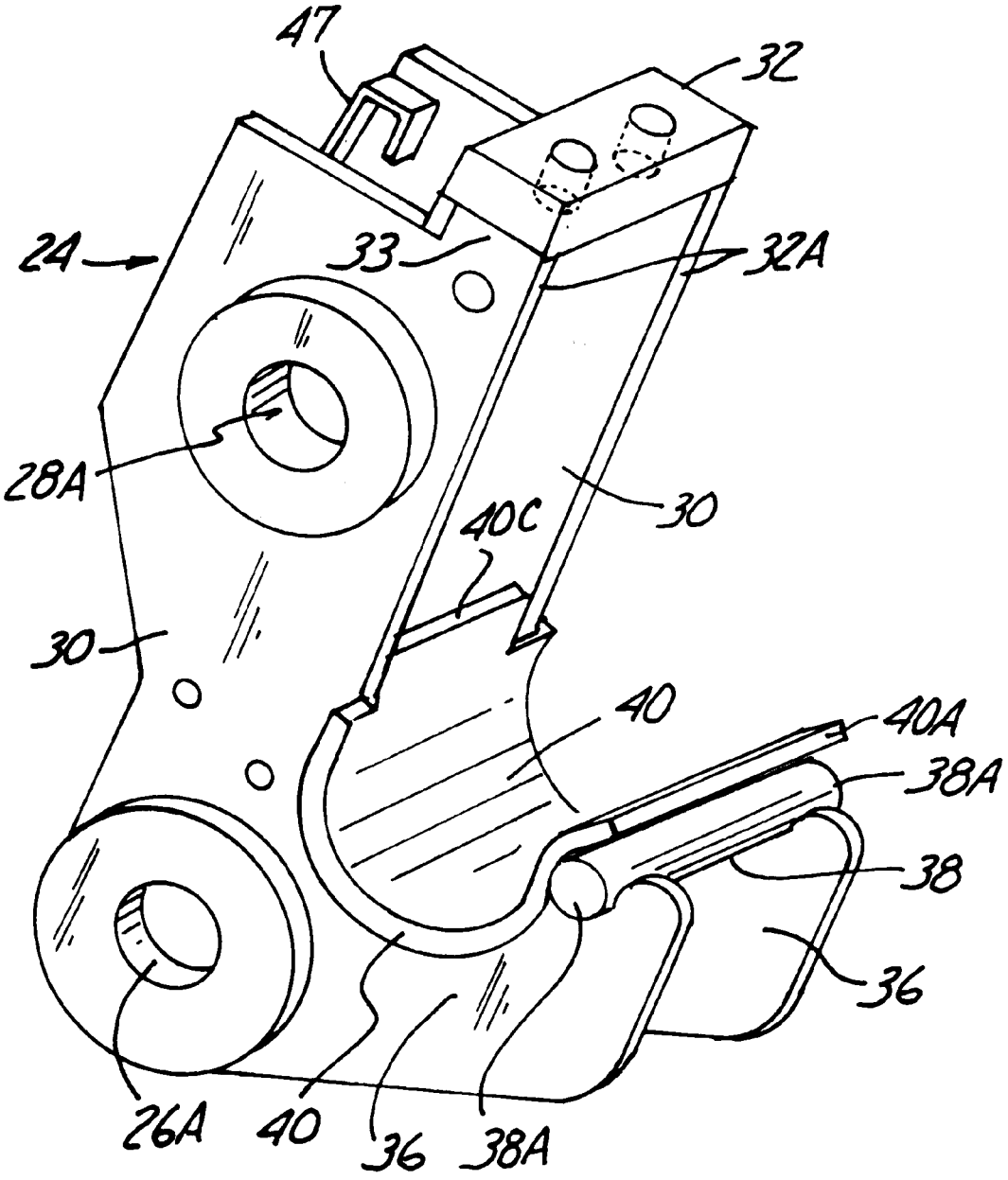
FIG. 2 is a perspective view of the quick attachment bracket detached from its supports on a backhoe or excavator arm.
Figure 3:
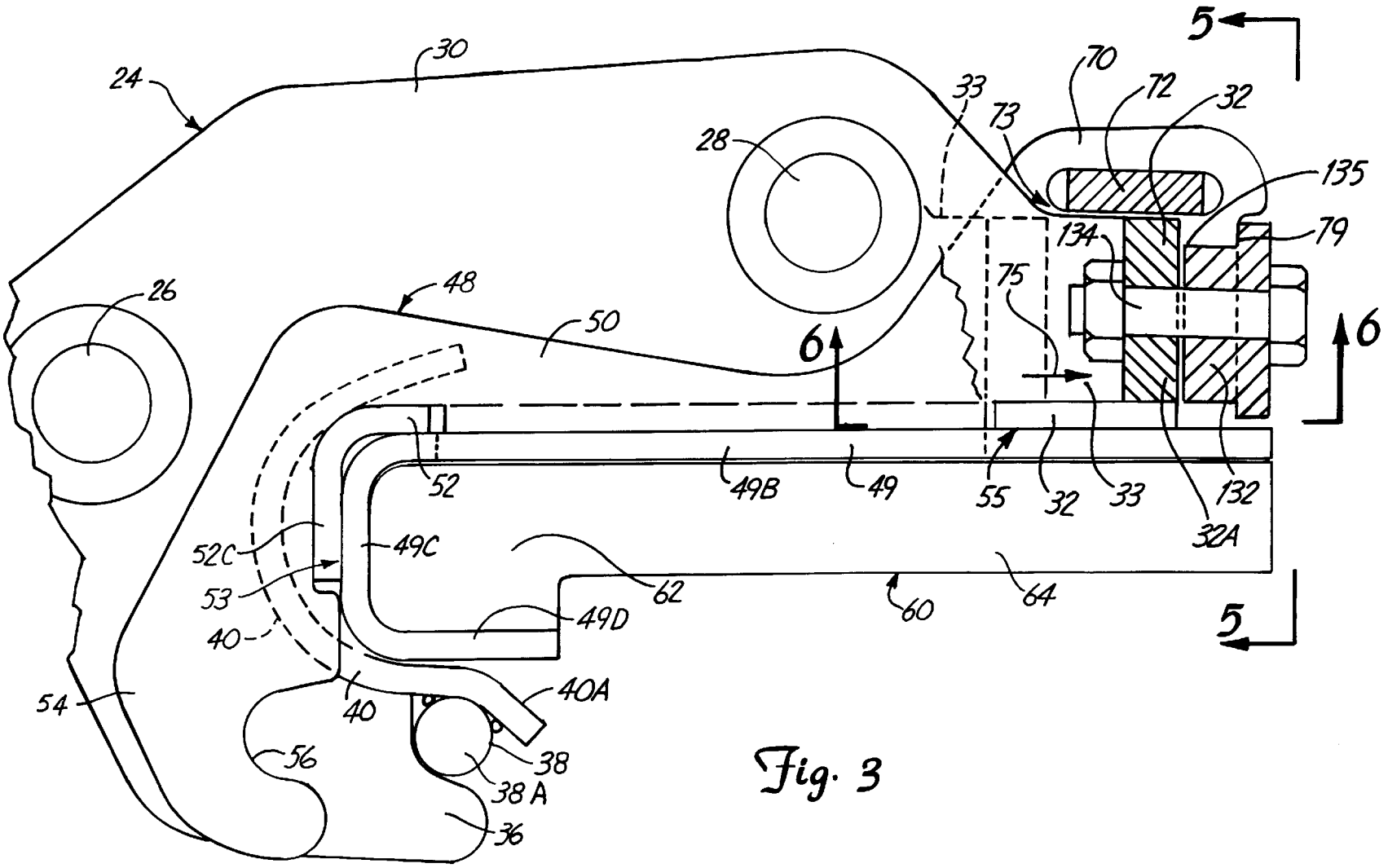
FIG. 3 is a side view of a mounting frame and quick attachment bracket in a secured position, with parts in section and parts broken away.
Figure 4:
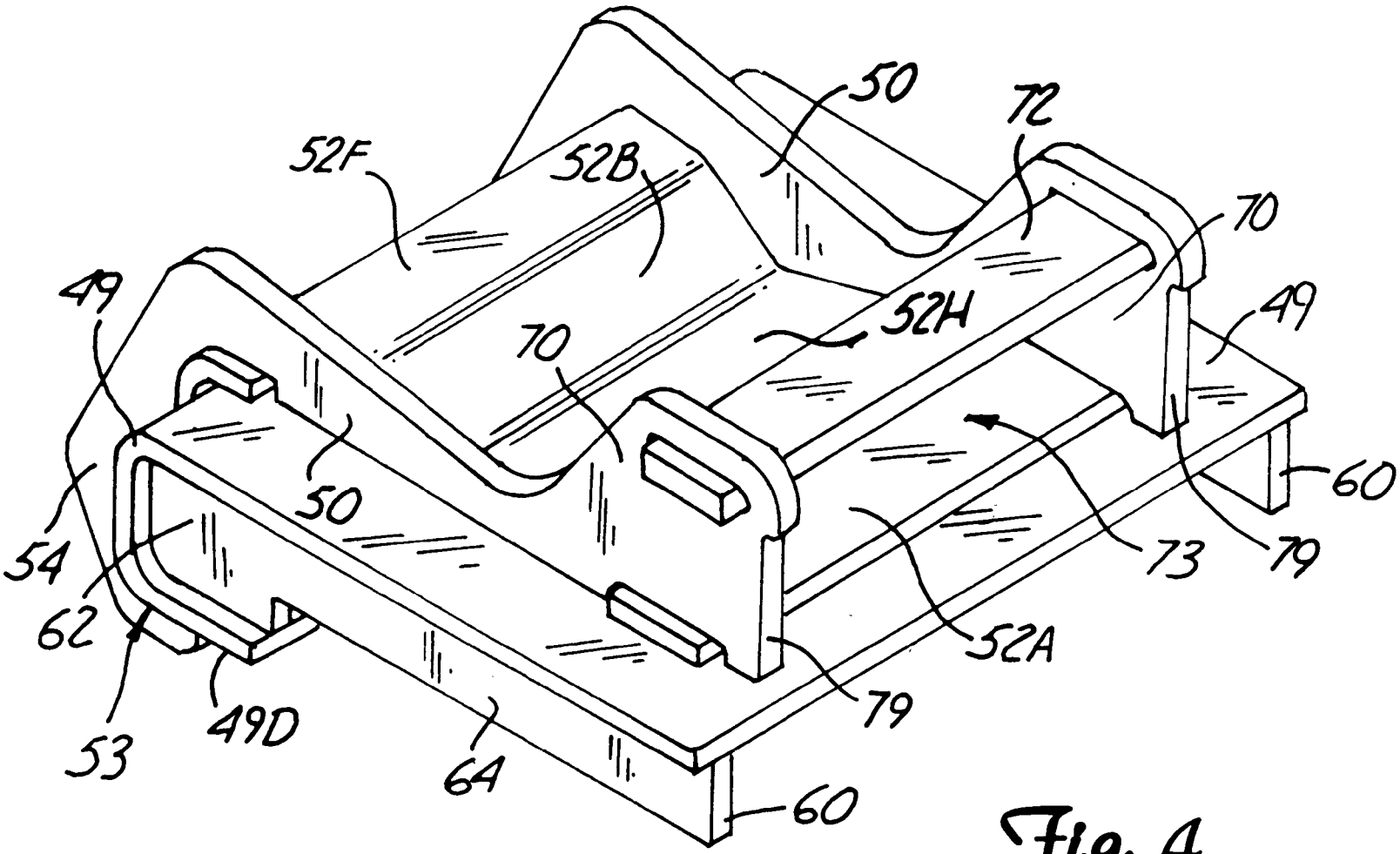
FIG. 4 is a side perspective view illustrating a mounting frame used in FIG. 1.

The quick attachment bracket 24 as best seen in FIGS. 1, 2 and 3 has a pair of side plates 30, 30 that support a cross nose bar 32 that extends across the space between the side plates 30 at a end portion or locking nose portion 33. The nose portion 33 is narrower in fore and aft directions and is used to provide a latching portion. The nose bar 32 is welded to the side plates 30 to form an assembly. The side plates 30 have lower support ears 36 that are recessed to support a "C" shaped saddle or retainer 40 that is a cross member or cross receptacle extending across the space between the side plates 30 and is welded thereto to secure the opposite ends of the plates 30 of the quick attachment bracket 24. A tongue 40C of the saddle extends between the side plates 30. The saddle is a retainer or latch portion that is at a first end portion of the bracket 24 and that is open in direction toward nose or latching portion 33 at a second end portion of the bracket 24.

The side plates 30 receive the main mounting pin 26 through bores 26A and the pin 26 extends across the space between the side plates 30. The linkage pin 28 also extends through bores 28A and extends across the space between the side plates 30.

A pin 38 is supported on the outer ends of the ears 36 of the side plates and is held in place partially under a lead-in lip 40A on one outer edge of the "C" shaped saddle 40. The pin 38 extends outwardly beyond the side plates 30 to provide support ends 38A, which are used to support a mounting frame 48, shown welded to the bucket in the first form of the invention, during mounting and releasing the frame and attached tool from the quick attachment bracket 24.

The mounting or attachment frame 48 is mounted to couple to quick attachment bracket 24 shown in FIGS. 1–4. The frame 48 is made up of side plates 50, 50 that are welded to a latch backing plate cross 52. The latch backing cross plate 52 is welded to an adapter cross plate 49 to make a cross plate assembly 55.

The backing cross plate 52 of frame 48 may be used, as shown in prior application Ser. No. 08/814,313, filed Mar. 10, 1997, to mate with and be retained by an automatic latch of quick attachment bracket 24. The present invention does not provide an automatic latch, but frame 48 can be made as a universal frame with little additional cost, so an automatic latching surface is shown for illustrative purposes. Plate 52 includes a planar flange portion 52A at one end. In the mid portions of the plate 52 it bends inwardly through opening 49A in adapter cross plate 49. An inclined automatic latch wall section 52B and a section 52H of cross plate 52 are formed to extend through opening 49A so the plate sections 52B and 52H protrudes through the opening to an opposite side of the plate 49 from portion 52A (see FIG. 1). Side plates 50 support the cross plate 52 along its side edges and the center portions also extend through opening 49A. The cross plate 52 has a section 52F that is coplanar with planar flange portion 52A and on the same side of the plane of cross plate 49 as portion 52A. The end of the cross plate 52 then has a flange 52C formed at right angles to the plane of the planar flange portion 52A and the wall section 52F, as well as at right angles to the main portion 49B of cross plate 49. The cross plate 52 can be left planar in the center portion for purposes of the present invention.

The cross plate 49 is formed inverted into a channel 53, forming a latch rim with flange 52C. Flange 52C forms part of the rim or channel 53, as perhaps can be best seen by referring to FIG. 3. The channel 53 is formed with a base wall 49C bent from plate portion 49B and an outer wall 49D is formed from cross plate 49 to extend back toward the opposite end of the plate 49. The channel base is double thickness with flange 52C.

The side plates 50 of the frame 48 are spaced wider than the side plates 30, the nose bar 32 and the "C" shaped saddle 40 of bracket 24. The side plates 50 thus will fit over the outside of the quick attachment bracket 24 when the bracket 24 seats on the quick attachment frame 48. The lower ends of the side plates 50 have ear or hook ends 54 with receptacles 56 formed in them for engaging rod ends 38A for support when installing or removing the frame from the bracket.

The attachment cross plate 49 of frame 48 forms an adapter plate providing a base for support of the frame to tools such as the bucket 20. The adapter cross plate 49 defines a reference plane for fastening additional supports that are used as welding or support brackets for various tools or attachments.

For example, in FIGS. 1 through 6, the adapter cross plate 49 is supported by brackets 60 that are welded to the adapter cross plate 49 and are notched so they support the interior of channel 53 with end portions 62 and have shank lengths 64 that support the cross plate assembly 55 and are sufficiently high so the automatic latch wall portions 52B and 52H of the plate 52 will not interfere with the back wall of a bucket on which the frame 48 is mounted. In FIG. 1 the frame 48 is welded to a conventional bucket back wall 20A. Using the adapter cross plate 49 and the brackets 60 makes it possible to convert buckets with pivot pin brackets to be mounted on a quick exchange system, by cutting off the existing brackets and welding on the frame 48 using the brackets 60 and the adapter cross plate 49.

The attachment frame 48 and the added brackets 60 permit mounting the attachment frame through the adapter cross plate to any tool that has a flat wall that is the normal attachment location for the tool.

The channel 53 forms a first latching rim or interlocking retainer engaging the quick attachment bracket 24. The interlocking of channel or rim 53 is done with a linear motion, and the first end of the attachment bracket 24 has a receptacle, the C shaped saddle 40, that is open in direction toward the nose portion or latching portion 33 and forms a first interlocking latching portion for engagement with rim or channel 53, while the nose portion 33 forms a second latching portion.

The side plates 50 have spaced apart ears 70 that protrude from the plate 52. These ears 70 have slots that receive a cross retainer bar 72, that is thus spaced from the parallel plate portion 52A of plate assembly 55 to form a receiver slot 73 for the nose portion 33 and cross nose bar 32. Upon sliding the quick attachment bracket 24 into latched position along plate 52 after the bracket has been pivoted clockwise in FIG. 1 until the edges 32A rest on plate portions 52A and 52F, the nose bar 32 and nose portion 33 will pass between the bar 72 and the plate portion 52A as the channel or rim 53 seats in the receptacle formed by C shaped channel 40 on the quick attachment bracket 24 as shown.

The attachment frame 48 can easily be installed on the quick attachment bracket 24 on the arm 16. When the bucket 20 or other tool is to be attached to the arm 16, the receptacles 56 of side plates 50 are hooked onto the ends 38A of the rod 38, with the bucket or tool in an appropriate stored position. The bucket can be stored by resting it on the ground. Elongated tools can be stored either to be in a substantially horizontal position, or supported in a vertical rack. Moving the arm 16 to the desired location and extending the actuator 22 will roll the quick attachment bracket 24 so that the nose bar 32 and nose portion 33 fit between the side plates 50, 50 and edges 32A can be rested against the plate portions 52A and 52F, which are part of plate assembly 55, when the receptacles 56 are supported on rod ends 38A. The relative position of bracket 24 and specifically nose portion 33 and nose bar 32 is shown in dotted lines in FIG. 3, before entering the receiver slot 73.

The channel or rim 53, including flange 52C, forms a retainer rim end that slips into the "IC" shaped saddle 40 receptacle or retainer by moving the arm 16 about its mounting pivot to linearly slide the attachment bracket 24 in direction as indicated by arrow 75 in FIG. 3 to engage and retain both ends of the attachment frame. The rim or channel 53 is held in "C" shaped member 40 and the nose portion 33 slides under the bar 72 to be held in slot 73 by bar 72, plate portion 52A and side plates 50.

For unlatching, the motion of the bracket 24 can be reversed to move so the bracket 24 and nose piece 32 is in the relative dotted position of FIG. 3. The receptacles 56 will receive the ends 38A of rod 38, so as the bracket 24 is lifted away from the frame 48 and the tool, the frame 48 and tool will hang on rod 38 for permitting movement to a stored location.

The bucket 20 or other tool thus can be quickly attached to or removed from a backhoe or excavator arm when using the adapter plate and frame of the present invention.

Figure 6:
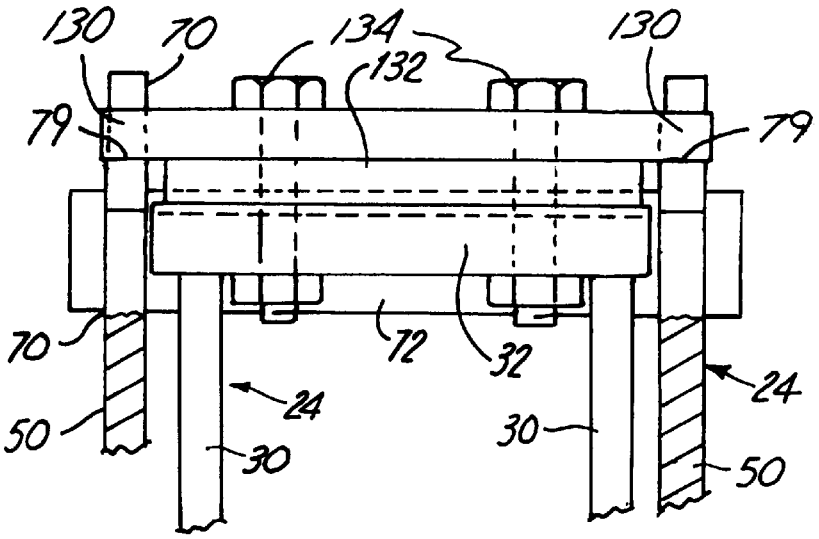
FIG. 6 is a sectional view taken on line 6—6 in FIG. 3.
Figure 5:
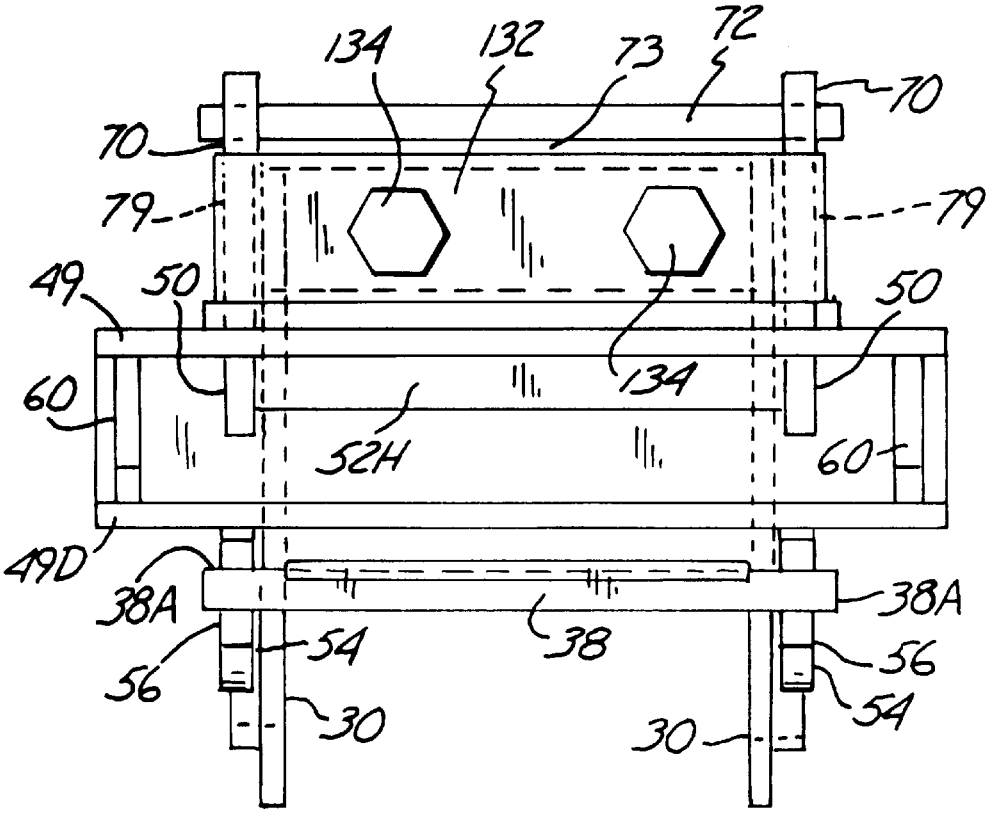
FIG. 5 is an end view taken generally along line 6—6 in FIG. 3.

FIGS. 3, 5 and 6 show the fastener connection for securing the frame 48 and bracket 24 together after they have been slid into position with nose bar 32 in receptacle 73 and channel 53 in saddle or retainer 40. The bracket and frame do not have to be fully seated, but nose bar 32 is close to its secured position.

The ears 70 have flat edge surfaces 79, on which end flanges 130 of a cross bar 132 rest. The cross bar 132 has a pair of bolt holes through which bolts 134 extend, and the bolts are long enough to extend through aligning holes in the nose bar 32. When the frame 48 and the bracket are slid almost into full engagement, the bolts 134 can be inserted through the aligning holes on the cross bar 132 and the nose bar 32 and tightened to securely hold the bracket and the frame 48 together. The nose bar 32 preferably will be spaced from the under surface of the cross bar 132 when the channel 53 first engages saddle 40 and the bolts 134 are first inserted. Tightening the bolts 134 exerts a seating force so channel 53 is seated tightly in saddle 40, and the space shown at 135 in FIG. 3 between the nose bar 32 and cross bar 132 can be left, if the bolts are torqued sufficiently. Usually the surface of the nose bar 32 and cross bar 132 are clamped so they are in contact when the bolts 134 are fully tightened and parts of bar 32 and cross bar 132 are preferably preloaded by the tension in bolts 134. This preload will be reacted to hold the channel 53 tightly in the saddle 40. Other fasteners can be used. Cap screws threaded into openings in the nose bar 32 can be used, and cam operated pins, which tighten by cam action can be used. The location of the fasteners can be changed as well. The fasteners can be used between saddle 40 and channel 53 to draw the parts together, or side mounted cams that operate between side plates 30 and 50 will work. Separate clips on the frame 48 and bracket 24 which receive fasteners are usable.

It is desirable to use fasteners that provide a locking force tending to urge the channel 53 securely into saddle 40 and to hold it under a sustained force.

Fast reliable operation for interchanging buckets or other attachments or tools is achieved. The ability to remove the bucket or other tool with the bucket or tool off the ground without having the bucket fall freely is helpful, and is achieved by use of the overlapping ears 54 and receptacles 56 on the frame 48, in combination with the ends 38A of rod 38 on the bracket 24. Grapples, power augers, hydraulic brackets, and many other tools can be supported on bracket 24.

Although the present invention has been described with reference to preferred embodiments, workers skilled in the art will recognize that changes may be made in form and detail without departing from the spirit and scope of the invention.

What is claimed is:

1. A frame for attachment to an attachment bracket on an implement arm, said frame including a pair of side plates and a cross plate joining said side plates and holding said side plates in spaced relationship, said side plates extending outwardly from the cross plate, said cross plate having a rim along one edge forming a retainer for fitting into a saddle of the bracket, said frame having walls forming a retainer slot at an end of the frame opposite from the rim, said walls being of size to slidably receive a first end portion of the bracket having the saddle and to slidably receive a second end portion of the bracket in the retainer slot when the rim is retained in the saddle, and at least one fastener supported on the frame to engage the bracket on which the frame mounts to draw the frame and bracket together to hold the second end portion in the retainer slot, and provide a force to seat the rim in the saddle.

2. The frame of claim 1, wherein said side plates have parallel spaced edges at an outer end of the retainer slot, and a cross bar supportable on the edges for carrying the fastener.

3. The frame of claim 2, wherein said walls forming the retainer slot comprise a portion of the cross plate extending between the side plates, the side plates defining a width of the slot, and a latch bar spaced from the portion of the cross plate and substantially parallel to the cross plate and supported on the side plates to define the slot.

4. The frame of claim 1, wherein said rim comprises a base wall portion of the cross plate substantially perpendicular to a plane of said cross plate.

5. The frame of claim 4, wherein said rim comprises a channel-shaped member, and the base wall portion comprises a base wall extending between corners formed by a junction of the base wall with joining walls perpendicular to the base wall, said corners being adapted to engage the saddle on the bracket, said fastener being positionable to provide a force on such bracket to urge the channel toward the saddle.

6. The frame of claim 1, wherein said walls forming the slot are on an opposite side of the cross plate from the rim.

7. The frame of claim 1, wherein said slot has a width extending between said side plates, and said rim has a width extending between said side plates, the spacing between an entry opening to the slot and rim being such that linear motion will engage both the rim and the slot with the first and second portions of the bracket on which the frame is mounted, and the fastener providing a linear force to urge the first bracket portion against the rim and the second bracket portion into the slot of the frame.

8. The frame of claim 7, wherein the side plates are substantially parallel and are spaced apart sufficiently to receive the bracket on which the frame is mounted, and the side plates having a pair of coplanar edge surfaces at an outer end of the receiver slot, a cross bar mountable on the edge surfaces, the fastener being supported on the cross bar and extending to engage a portion of the bracket to urge the portion of the bracket into the receiver slot.

9. A frame and support bracket combination for attachment to an implement arm, said bracket including a pair of bracket side plates, a cross saddle at a first end of the bracket side plates and a cross nose bar at a second end of the bracket side plates, said frame including a pair of frame side plates and a cross plate having a plane joining said frame side plates and holding said frame side plates in spaced relationship, said frame side plates extending outwardly from the cross plate and extending from a first end to a second end of the cross plate, said cross plate having a rim with at least a base wall generally perpendicular to the plane of the cross plate at the first end, said frame having walls forming a retainer slot between the frame side plates at the second end of the cross plate, said slot having an open end between the side plates facing in direction toward the first end of the frame, the rim fitting into the cross saddle of the bracket and the cross nose bar being received in the slot in a frame seated position, and at least one fastener between the frame and the bracket to urge the rim and the cross saddle together to hold the frame and bracket in the seated position.

10. The combination of claim 9, wherein said walls forming the retainer slot comprise a portion of the cross plate extending between the frame side plates, and a bar spaced from the portion of the cross plate and substantially parallel to the plane of the cross plate and supported on the frame side plates, a cross member extending between the frame side plates at an end of the slot opposite the open end, the at least one fastener comprising a threaded fastener supported on the cross member and tightenable to exert a load on the cross nose bar to urge the frame and bracket toward the seated position.

11. The combination of claim 9, wherein said rim comprises a channel-shaped member, a base wall extending between corners formed by the base wall with joining walls perpendicular to the base wall, said corners being adapted to engage a saddle on a bracket and being loaded there against by the force from the at least one fastener.

12. The combination of claim 11, wherein said walls forming a slot are on an opposite side of the plane of the cross plate from the base wall, the space between the side plates being unobstructed between the first end of the cross plate and the slot formed at the second end of the cross plate.

13. The combination of claim 9, said frame side plates having end edges that are generally coplanar adjacent the second end of the cross plate, a cross member rested on the end edges and carrying the at least one fastener for applying a tension load to draw a portion of the bracket in the slot toward the cross member.

14. A frame kit for mounting on a bracket having a cross receptacle at a first end and a locking cross nose at a second end, the kit including a frame having a pair of frame side plates joined together with a cross rim at a first frame end to mate with a cross receptacle of the bracket, and walls forming a slot at a second frame end to receive a locking nose of such bracket, a cross bar member supportable between the frame side plates at the second end of the frame to overlie an outer end of the slot, and a fastener supportable on the cross bar member to engage and exert a force on the bracket mounting the frame to urge the cross rim into the cross receptacle of such bracket and retain the cross rim in the cross receptacle of such bracket.

15. The kit of claim 14, wherein said fastener comprises a threaded fastener that extends through the cross bar member and engage a portion of the locking nose of the bracket on which the frame is mounted.

16. A method of securing a frame onto a quick attachment bracket mounted on an implement arm, the bracket having portions that receive and interlock with the frame in at least two locations upon linear movement, including the steps of moving the arm to place frame and bracket adjacent each other, linearly moving the frame and bracket relative to each other to interlock the frame with the bracket portions, and securing the frame and bracket together with a fastener extending between the frame and bracket and exerting a force in direction of linear movement to urge interlocking and search of the frame and bracket portions.

17. The method of claim 16 including the further step of providing a cross member supported on the frame having an aperture therethrough, passing the fastener through the aperture, and threadably tightening the fastener to draw the bracket and frame together.

18. The method of claim 17 including the step of supporting a removable cross member on support surfaces on the frame in alignment with a nose portion of the bracket, and tightening the fastener between the cross member and the nose portion of the bracket.

* * * * *